United States Patent [19]

Halberstadt et al.

[11] Patent Number: 4,598,194

[45] Date of Patent: Jul. 1, 1986

[54] QUARTZ INFRA-RED LAMPS

[75] Inventors: Alex L. Halberstadt, London; John A. Letchford, Enfield, both of England

[73] Assignee: Thorn EMI plc, London, England

[21] Appl. No.: 754,689

[22] Filed: Jul. 15, 1985

Related U.S. Application Data

[63] Continuation of Ser. No. 592,850, Mar. 23, 1984, abandoned.

[30] Foreign Application Priority Data

Mar. 24, 1983 [GB] United Kingdom ..... 8308103

[51] Int. Cl.[4] ..... H05B 3/68

[52] U.S. Cl. ..... 219/464; 219/354; 219/461; 219/462; 219/463; 313/113; 313/277; 313/315; 338/234

[58] Field of Search ..... 219/347, 354, 355, 356, 219/357, 405, 411, 449, 446, 461, 462, 463, 464, 466, 524, 525, 553; 338/234, 235; 99/425; 313/113, 274, 315, 317, 378, 379; 337/394

[56] References Cited

U.S. PATENT DOCUMENTS

| | | | |
|---|---|---|---|
| 2,601,011 | 6/1952 | Wilcox | 219/461 |
| 2,844,699 | 7/1958 | Miscella | 219/354 X |
| 2,859,368 | 11/1958 | Biggs et al. | 313/113 |
| 2,864,025 | 12/1958 | Foote et al. | 219/354 X |
| 2,980,820 | 4/1961 | Brundige et al. | 313/279 |
| 3,005,081 | 10/1961 | Kordes et al. | 219/354 X |
| 3,052,037 | 9/1962 | Miskella | 219/354 X |
| 3,052,789 | 9/1962 | Trainor | 219/354 X |
| 3,304,406 | 2/1967 | King | 219/411 |
| 3,355,574 | 11/1967 | Bassett, Jr. | 219/464 |
| 3,360,765 | 12/1967 | Strange et al. | 219/354 X |
| 3,407,285 | 10/1968 | Jacobs | 219/456 |
| 3,579,021 | 5/1971 | Kimball | 313/274 |
| 3,626,154 | 12/1971 | Reed | 219/411 |
| 3,663,798 | 5/1972 | Speidel et al. | 219/464 |
| 3,714,885 | 2/1973 | Wertheimer et al. | 99/425 |
| 3,735,185 | 5/1973 | Bonazoli et al. | 313/278 |
| 3,836,751 | 9/1974 | Anderson | 219/411 |
| 4,069,437 | 1/1978 | Notelteirs et al. | 313/315 |
| 4,324,126 | 4/1982 | Riech et al. | 219/354 X |
| 4,406,944 | 9/1983 | Crain et al. | 219/354 X |

FOREIGN PATENT DOCUMENTS

| | | | |
|---|---|---|---|
| 949677 | 9/1956 | Fed. Rep. of Germany | 219/354 |
| 1108995 | 1/1956 | France | 219/354 |
| 105454 | 7/1963 | Netherlands | 219/354 |
| 1273023 | 5/1972 | United Kingdom . | |
| 1282656 | 7/1972 | United Kingdom . | |
| 2132060 | 6/1984 | United Kingdom . | |

*Primary Examiner*—Volodymyr Y. Mayewsky
*Attorney, Agent, or Firm*—Fleit, Jacobson, Cohn & Price

[57] ABSTRACT

An infra-red lamp consists of a quartz tubular envelope sealed at each end with a respective pinch seal. A tungsten filament supported within the envelope is electrically connected, via a molybdenum foil strip and lead wires within the pinch seal to a connector for connection to a power supply. Each pinch seal is substantially wholly enclosed within a ceramic housing, which is preferably provided with a locating flange, to protect the pinch seal in part from heat emitted by the filament and to assist in location of the lamp in an operating environment.

5 Claims, 7 Drawing Figures

QUARTZ INFRA-RED LAMPS

This application is a continuation of application Ser. No. 592,850, filed Mar. 23, 1984, now abandoned.

The present invention relates to quartz-halogen linear filament infra-red lamps.

Tungsten halogen linear filament lamps have been provided, consisting of a tubular quartz or other high silica content glass envelope having at each end an electrical lead through sealed in a respective pinch seal.

The lamps have a linear tungsten filament of well established form extending between the through-leads and appropriately supported within the envelope. They are filled with a suitable fill gas to operate according to the well known tungsten halogen regenerative cycle.

Such lamps are generally for the purpose of illumination but have also been adapted for the purpose of heating. To that end the filament dimensions and electrical rating, are chosen to emit primarily in the infra-red. By this means lamps rated at about 350 watts to about 2.0K watts have been produced, most of the energy being available as heat, for example for paint drying.

It has been proposed in a co-pending patent application No. 8320717 in the name of THORN EMI Domestic Electrical Appliances, to use an array of such lamps disposed beneath a ceramic hub surface to provide an element unit for a cooker hob. In such an environment the conventional infra-red lamp construction, in particular the construction of the end connection, has proved to be less satisfactory than was hoped to be the case.

It is an object of this invention to provide an improved construction of linear filament infra-red lamp for the said purpose.

According to the invention there is provided a halogen cycle infra-red lamp including a generally linear filament supported within a tubular envelope of high silica content glass having, at each end thereof: a pinch seal with an electrical lead to the respective end of the filament sealed therein; an electrical connection means for coupling said filament to an electrical power supply, said connection means being electrically connected to said electrical lead and emergent externally from said pinch seal; and a ceramic housing substantially enclosing the pinch seal to protect the seal in part from heat emitted by the filament and to assist in location of the lamp in an operating environment.

Preferably the electrical connection means is a spade connector.

Preferably the ceramic housing allows a heat transfer connection with a mating locating means in a unit in which the lamp is used and to that end it may have flat outer surfaces being, for example, rectangular in section. Preferably also it includes a locating flange.

Preferably the lamp envelope is coated along substantially its entire length and for about half of its circumference with an infra-red reflective coating.

Figure 1:
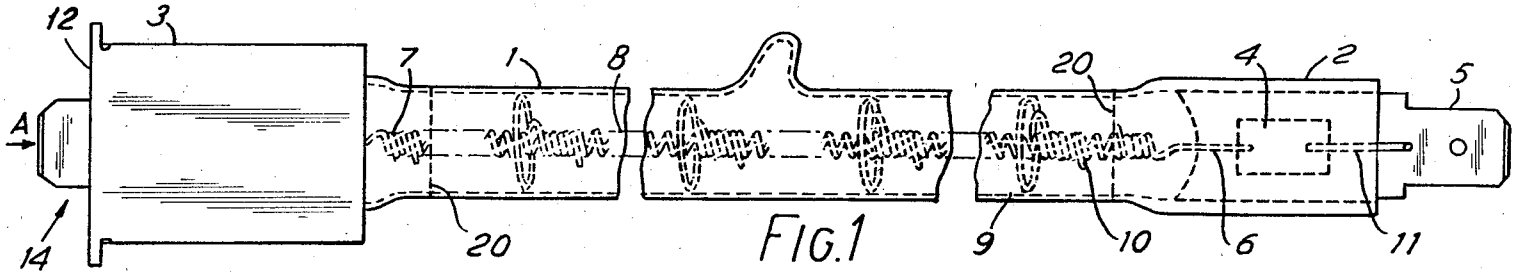
Figure 3:
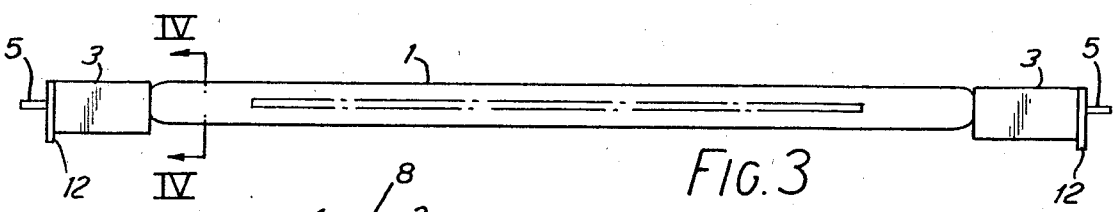
Figure 4:
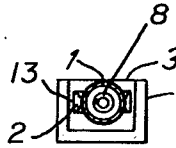
Figure 2:
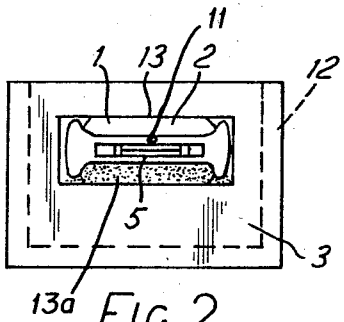
Figure 5C:
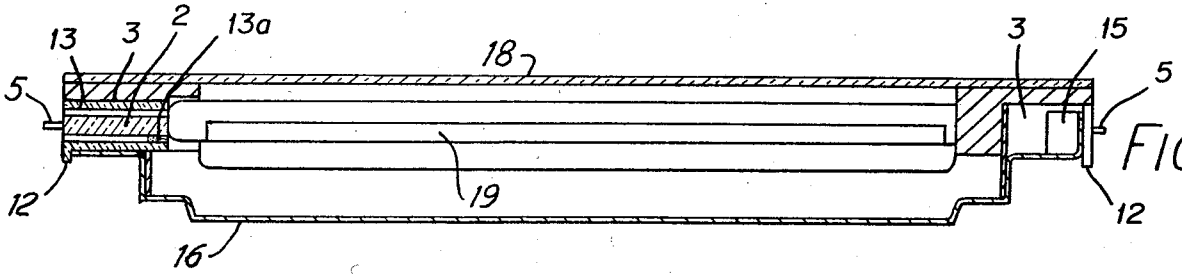
Figure 5B:
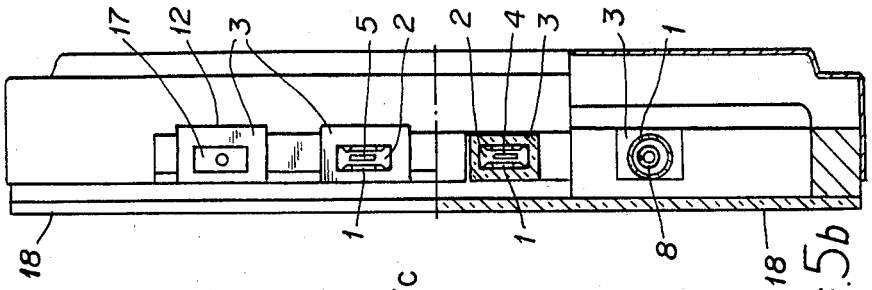
Figure 5A:
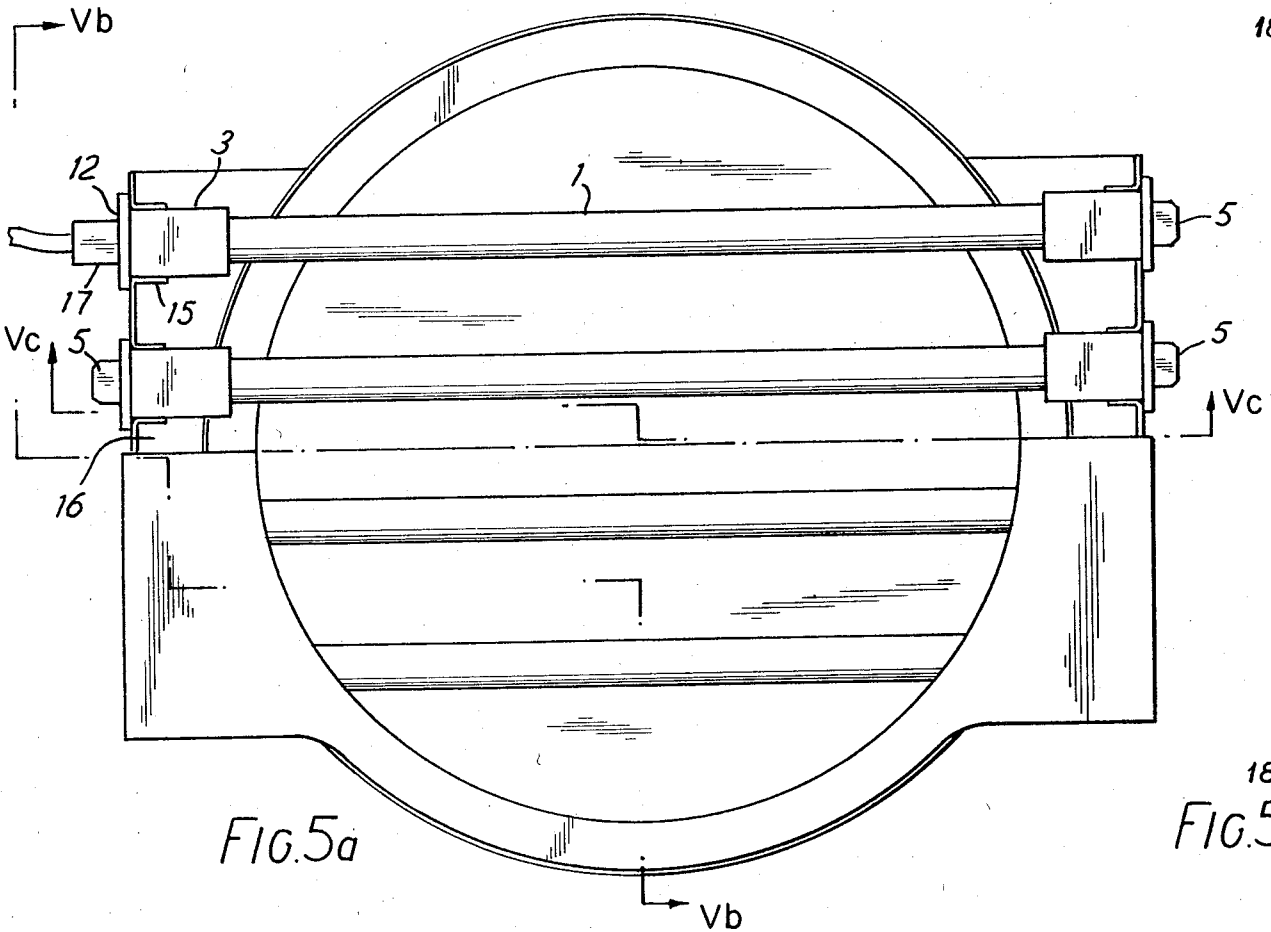

In order that the invention may be clearly understood and readily carried into effect it will now be described by way of example with reference to the acompanying drawings, of which, FIG. 1 shows a view from above of a linear filament tungsten halogen infra-red lamp incorporating the invention, FIG. 2 shows an end elevation (viewed from A) of the lamp of FIG. 1, FIG. 3 shows in its entirety, a lamp in accordance with the invention for better illustration of its proportions, FIG. 4 is a sectional view on IV—IV of FIG. 3 and FIG. 5*a* shows a plan view of a heating unit, incorporating the present invention, to be mounted beneath a glass ceramic cooking surface of a cooking hob, FIG. 5*b* shows a sectional view through Vb—Vb in FIG. 5*a*, with the heating unit disposed beneath the glass ceramic cooking surface, and FIG. 5*c* shows a sectional view through Vc—Vc in FIG. 5*a*, also with the heating unit disposed beneath the glass ceramic cooking surface.

In the lamp of FIG. 1, a tubular envelope 1 of quartz, or other high silica content glass, is sealed at each end with a respective pinch seal 2. Each end of the lamp is fitted with a ceramic cap 3 but in FIG. 1 the end cap is omitted from one end to show the structure within it. Molybdenum foil strips 4 in the pinch seals 2 connect a contact 5 with filament lead wires 6, which terminate in screw coils 7, screwed into the end of a coil, or coiled coil, filament 8. Spaced filament supports 9 are spirals of tungsten wire fitting loosely in the tube 1 and terminating axially in coils 10 which are wound into the filament coil and mesh therewith.

As this far described the lamp of FIG. 1 is similar to a conventional linear filament tungsten halogen lamp. To provide an infra-red lamp the filament rating and operating temperature are chosen appropriately to make the lamp operate to a greater degree in the infra-red.

The lamp of FIG. 1 differs from the known linear filament infra-red lamp in the construction of the end connections. It is considered to be desirable, for the use in domestic electric cooker hobs mentioned hereinbefore, for the end connection to be by a push-on connection whereby electrical connection to the lamp may be by a flying-lead method, allowing it to be independent of the support of the lamp. For this reason a lead 11 emergent from the pinch seal is welded to an appropriate connector, in the preferred example shown, a spade connector, which forms the contact 5. Electrical connection thereto is then by an appropriate female connector.

At each end of the lamp, illustrated at the left hand end in FIG. 1, the pinch seal is enclosed in a moulded ceramic housing which forms the ceramic cap 3. The ceramic clearly should be able to resist the heat generated and a material such as Steatite is suitable. This housing 3 differs from the prior art ceramic cap in that it substantially wholy encloses the pinch seal 2. Furthermore, as shown in the end elevation of FIG. 2, it is of generally rectangular cross section having a flange 12 at the outer end and on three sides thereof, for location purposes.

The housing 3 has a generally rectangular aperture 13 extending therethrough generally axially so that the pinch seal may be inserted therein with the spade terminal 5 emergent from the outer end as shown at 14. It will be appreciated that the connectors 5 need not be visibly emergent from the aperture if not required but they must be effectively emergent to a sufficient extent to allow connection to be made. The apertures 13 are of sufficient size to make the pinch seal 2 a relatively loose fit therein and the lamp is then secured by filling the lower part of the aperture with a suitable cement 13*a* (a high temperature cement such as Sauereisen cement), leaving clear space for the mating female connector to be inserted.

This construction is devised in part to allow rapid and convenient electrical connection in production of the cooker and also rapid and convenient location of the lamp in the element array. There is, however, a further consideration in its design, namely a beneficial construction in relation to heat dissipation in an infra-red element.

The ceramic housing 3 by substantially enclosing the pinch seal 2 acts in part as a heat sink and in part as a shield between the heat emitting filament 8 and the electrical connection between connector 5 and its mating connector.

The unit into which the lamp of FIGS. 1 and 2 is located is provided itself with locating casings which act as heat sinks. These are arranged to locate and contact the housing so as to improve the heat transfer therefrom and the heat sink effect. The fit of the housing 3 in these casings should, however, be sufficiently free to allow for expansion of the ceramic during operation, to prevent damage to the lamp, unless care is taken to match the respective coefficients of expansion.

The lamp of FIG. 1 is incomplete as illustrated because the proportion of length to diameter of a typical 500 watt lamp does not facilitate illustration. To more clearly illustrate typical proportions the lamp is shown in full in side elevation in FIG. 3 and in section on IV—IV of FIG. 3 in FIG. 4.

Thus 240 V, 500 watt lamp is typically about 240 mm total length, about 190 mm envelope length and about 140 mm filament length. Lamps of other ratings may be used and these would, of course, have different dimensions.

An element unit for a cooker hob, incorporating four 500 watt lamps is shown in plan, end and side elevation in FIGS. 5*a*, 5*b* and 5*c* respectively.

Except insofar as these figures show lamps according to this invention and as described herein, FIGS. 5*a*, 5*b* and 5*c* show a construction for the unit which is the subject matter of the above-mentioned patent application No. 8320717. It can be seen that the ceramic housings 3 are located, with the assistance of flanges 12, in locating members 15 in a casing 16 which aids the heat sink effect. Electrical connection is in this example by female connectors 17 of which only one is shown.

The mounting is such that four lamps are mounted in parallel positions inside casing 16 and beneath a suitable ceramic surface 18 which is the cooking surface in conventional manner.

To prevent excessive emission of visible light the ceramic surface 18 may be coloured, preferably red. However the lamp itself may have an infra-red transmissive red shield or be of the beneficial construction, for reducing emission of visible light.

Although the lamp described herein includes a particular internal construction and filament support, it will be appreciated that this internal construction is immaterial to the present invention and may be varied as desired.

In the construction shown in FIGS. 5*a*, 5*b* and 5*c* it is found beneficial if the lamp is coated for substantially its entire length and about half of its circumference with a heat reflective coating which, as shown at 19 in FIG. 5*c*, is disposed to reflect heat emitted from the filament 8 of the lamp away from the lower part of casing 16 to the ceramic surface 18. That coating is a preferred feature of the lamp of the present invention and, referring again to FIG. 1, extends between the limits shown at 20.

A suitable coating is a gold or rhodium coating, which is applied to the quartz by a suitable process, such as evaporation or by use of an electron beam gun, and may also require a suitable protective layer over it. Alternatively aluminium oxide may be used as a suitable coating, which may for example be flame-sprayed onto the quartz envelope. Another alternative suitable coating is titanium dioxide, which may be mixed with a glass frit.

We claim:

1. An infra-red lamp assembly, suitable for use in a domestic cooking hob, including a generally linear filament supported within a tubular envelope of high silica content glass, each end of said envelope comprising: a pinch seal having sealed therein electrical connection means for coupling the respective end of said filament to an electrical power supply, said connection means including an electrical connector emergent externally from said pinch seal; a one-piece moulded housing of heat-resistant material substantially enclosing said pinch seal along substantially the entire length of the seal to protect the seal from heat emitted by the filament, said pinch seal being fixedly secured in said housing by heat-resistant bonding material, and said housing having an essentially rectangular exterior configuration to assist in location of the lamp assembly in an operating environment; and an internal aperture extending axially through said housing and through which connection of said electrical connection means to said power supply is implemented, said internal aperture being of essentially rectangular configuration adjacent at least one end of said housing for initially receiving said pinch seal therein in loose-fitting relationship, said electrical connection means extending axially through said internal aperture, said electrical connector being located adjacent an opposite end of said housing, and said connector and said internal aperture of said housing defining a space in said housing for receiving a female connector to be pushed onto said connector.

2. A assembly lamp as claimed in claim 1 wherein said electrical connection means comprises an electrical spade connector.

3. A assembly lamp as claimed in claim 1 wherein said envelope is coated with an infra-red reflective coating, said coating extending along substantially the entire length of said envelope and around substantially half of the circumference of said envelope.

4. A assembly lamp as claimed in claim 1 wherein said filament consists of a coiled coil filament.

5. A cooking hob incorporating at least one heating unit and a cooking surface, said heating unit including at least one infra-red lamp assembly and support means for supporting said lamp assembly beneath said cooking surface, said lamp assembly including a generally linear filament supported within a tubular envelope of high silica content glass, each end of said envelope comprising: a pinch seal having sealed therein electrical connection means for coupling the respective end of said filament to an electrical power supply, said connection means including an electrical connector emergent externally from said pinch seal; a one-piece moulded housing of heat-resistant material substantially enclosing said pinch seal along substantially the entire length of the seal to protect the seal from heat emitted by the filament, said pinch seal being fixedly secured in said housing by heat-resistant bonding material, and said housing having an essentially rectangular exterior configuration to assist in location of the lamp assembly in said support means; and an internal aperture extending axially through said housing and through which connection of said electrical connection means to said power supply is implemented, said internal aperture being of essentially rectangular configuration adjacent at least one end of said housing for initially receiving said pinch seal therein in loose-fitting relationship, said electrical connection means extending axially through said internal aperture, said electrical connector being located adjacent an opposite end of said housing, and said connector and said internal aperture of said housing defining a space in said housing for receiving a female connector to be pushed onto said connector.

* * * * *